US006637744B2

(12) United States Patent
Bettinelli

(10) Patent No.: US 6,637,744 B2
(45) Date of Patent: Oct. 28, 2003

(54) DEVICE FOR POSITIONING SHEETS IN A MACHINE STATION

(75) Inventor: Fabio Bettinelli, Ecublens (CH)

(73) Assignee: Bobst S.A. (CH)

( * ) Notice: Subject to any disclaimer, the term of this patent is extended or adjusted under 35 U.S.C. 154(b) by 118 days.

(21) Appl. No.: 09/847,742

(22) Filed: May 2, 2001

(65) Prior Publication Data

US 2001/0040334 A1 Nov. 15, 2001

(30) Foreign Application Priority Data

May 5, 2000 (CH) ..... 2000 0883/00

(51) Int. Cl.[7] ..... B65H 5/12; B66C 1/48

(52) U.S. Cl. ..... 271/226; 271/268; 271/277; 294/88; 294/106

(58) Field of Search ..... 271/268, 277, 271/204, 205, 206, 82, 85; 294/106, 88

(56) References Cited

U.S. PATENT DOCUMENTS 3,929,368 A * 12/1975 Ryden et al. ..... 294/88 X
4,270,652 A * 6/1981 Lay et al. ..... 271/85 X
4,297,066 A * 10/1981 Ramcke et al. ..... 271/85 X
4,550,905 A * 11/1985 Heiland ..... 271/85 X
5,324,124 A * 6/1994 Bayerle et al. ..... 400/636
5,588,688 A * 12/1996 Jacobsen et al. ..... 294/106
6,419,223 B1 * 7/2002 Sting et al. ..... 271/268 X

* cited by examiner

*Primary Examiner*—Kathy Matecki
*Assistant Examiner*—Minh-Chau Pham
(74) *Attorney, Agent, or Firm*—Ostrolenk, Faber, Gerb & Soffen, LLP

(57) ABSTRACT

A device for positioning sheets in a station of a sheet-processing machine comprising a movable bearing surface for holding at least one edge zone of a sheet, actuators driving the bearing surface in the plane thereof, sheet grippers accompanying the motion of the bearing surface and adapted to grip or release the edge zone of the sheet between sheet grippers and the bearing surface. The sheet grippers are connected to the bearing surface by at least one joint comprising a number of levers forming a parallelogram articulated around horizontal pivot axes. A piston comprising a permanently compressed spring eliminates the radial clearance between the pivot axes. Lateral clearance thereof is eliminated by a spring strip which is rigid in the transverse direction.

10 Claims, 2 Drawing Sheets

DEVICE FOR POSITIONING SHEETS IN A MACHINE STATION

BACKGROUND OF THE INVENTION

The invention relates to a device for positioning sheets in a station of a sheet-processing machine, comprising a movable bearing surface for holding at least one edge zone of a sheet, actuating means for moving the bearing surface in the plane thereof, and gripping means accompanying the movement of the bearing surface and adapted to grip or release the said edge zone of a sheet between a sheet-gripping means and the bearing surface.

In machines such as multiple-station shaping presses for processing sheets of paper or full board or corrugated cardboard, the sheets must be very accurately positioned in both the longitudinal and the transverse direction in each of the stations through which they pass. Usually when a sheet is inserted into the machine, the front edge of the sheet is gripped by a conveying means such as a gripper bar comprising a number of grippers mounted on a transverse bar integral with side chains and subsequently conveying the sheet to the downstream processing stations of the machine, such as the cutting station or the waste-ejection station. The terms "front", "longitudinal", "transverse" and "lateral" here are used with reference to the direction in which the sheets travel through the machine. In these stations, the problem of positioning the sheet is solved by positioning the shaping tools relative to the positions at which the gripper bar stops. The accuracy and productivity of the downstream processing stations will therefore depend on the accuracy of gripping.

The stacks of sheets are brought on a pallet and inserted into a feeder. The feeder ensures a regular supply of sheets to the feed board, which drives the sheets in a layer so that they can be gripped and conveyed to the downstream stations.

In currently-used positioning devices, the sheet on the feed table is aligned against front and lateral stops by feed means such as rollers or belts or elastic material on top, which come down and press against the feed board, or a pair of rollers disposed above and below the board. In the case of rough sheets, the front and lateral stops are disposed accurately with respect to the reference positions of the downstream stations. The sheet is rapidly pushed against the stops by the feed means, then gripped by a gripper bar. The stops are then retracted and the gripper bar can pull the sheet into the next processing station and position it accurately with respect to the tools on the work surface of the said station.

The problem of positioning is particularly troublesome when the sheet has undergone one or more previous processing operations such as printing or scoring the folding lines, since the subsequent operations must be performed very accurately with reference to the preceding processing. It is therefore advantageous to equip the sheet-positioning devices with systems for adjusting the position.

Patent CH 676 695 describes a positioning device in which the stops are motor-driven so as to control and vary their position and wherein a printed or other mark resulting from a previous processing operation can be detected by opto-electronic scanning means in order to adjust the position of the stops and consequently of the sheet, directly in dependence on the measured position of a said mark.

However, positioning devices with stops require each sheet to be practically immobilised during the entire aligning and adjustment operation thereof, thus greatly limiting the speed at which the sheets pass through the machine.

Patent application CH 0671/99 by the applicants describes a device for positioning sheets in the feed station of a sheet-processing machine of the kind defined hereinbefore, for operating the machine at much higher speeds. The sheet-gripping means is in the form of a transverse bar bearing lugs, all of which form a comb disposed above the bearing surface, with lateral uprights secured to the bar and each articulated at a single pivot point situated at the level of the movable bearing surface. The sheet-gripping means is controlled by a spring under pressure disposed between the bar and the bearing surface and tending to press the lugs of the sheet-gripping means against the bearing surface, and is also controlled by one or two control levers on the feed station, connected by a telescopic swinging rod to the rear of the bar and pushing and opening the sheet-gripping means by pivoting it.

The positioning process according to CH 0671/99 uses a horizontal bearing surface driven by actuators such as linear electric motors in longitudinal reciprocation and also in complementary corrective motion in longitudinal and/or transverse translation and/or in rotation around a vertical axis. This method, starting from the bearing surface in the starting or rear position, consists in engaging the sheet-gripping means on the bearing surface and then in controlling the actuators in order to move the bearing surface forward and if necessary sideways or crossways in dependence on the position co-ordinates of the sheet scanned by opto-electronic means during the advance of the bearing surface, so as to bring the front edge of the sheet in the grippers of a gripper bar into a precise, predetermined position, release the gripping means of the positioning device, and then return the bearing surface to the rear or starting position.

This method can substantially increase the productivity of the machine to up to 12,000 sheets per hour, whereas stop devices can only reach outputs of the order of 8,000 sheets/hour. However, this positioning device is not free from faults:

When the control lever or levers for opening the sheet-gripping means are put in to operation, the result is an impact and a consequent quasi-instantaneous force. Since the centre of inertia of the said means is separate from its pivot axis, the resultant of the forces has a horizontal component which affects the actuators. In particular, when the lever controlling the bar of the sheet-gripping means is on one side only, it pushes the bar via a rod and produces a torque which interferes with adjustment by rotation of the position of the sheet.

Even in the case where one control lever at each side acts on the sheet-gripping means, the push may cause a deflection, i.e. an error of up to a few tenths of a millimetre in the position at which the bearing surface stops. Such a deflection is disturbing, inter alia in the case where the sheet for processing is printed, when some outlines of the printing must coincide very accurately with the shape of the cut sheets.

Also, at the very high production rates made possible by this device, a recurrent horizontal component of a force when the sheet-gripping means is opened may interfere with the adjustment of the lateral linear motors, putting the position-correcting system out of action. In extreme cases there may be a resonance between the interfering force and the motors, resulting in jamming of the machine.

SUMMARY OF THE INVENTION

The aim of the invention is to eliminate these defects.

To this end, in a device of the kind defined in the preamble, the sheet-gripping means is connected to the bearing surface by at least one joint comprising a number of levers forming an articulated parallelogram.

In the device according to the invention, starting-up of the controls for opening the sheet-gripping means does not result in any appreciable interfering horizontal force capable of affecting the actuators for moving the surface bearing the sheet-gripping system.

The joint can comprise a fixed upright secured to the bearing surface and receiving an upper fixed pivot and a lower fixed pivot, disposed substantially one above the other.

Preferably the sheet-gripping means is connected to the pivot by an actuating lever and a return lever forming an articulated parallelogram.

More particularly the joint may comprise an upper actuating lever connected at its central part for rotation around the upper fixed pivot, its first end being rotatably connected to a lever for controlling the gripping means and its second end being connected to a movable upright, and the joint also comprises a lower return lever connected at its first end for rotation around the lower fixed pivot and connected at its second end for rotation around the lower end of the said movable upright, the said movable upright being integral with the sheet-gripping means.

Preferably a piston and spring permanently act on the lower return lever so as to press the sheet-gripping means against the bearing surface.

Of its nature, this kind of joint has a very small radial clearance at the level of the pivots and having an interfering effect on the actuators for moving the bearing surface at the moment when the sheet-gripping means is opened. To counteract this clearance, the movable upright integral with the sheet-gripping means is connected to the fixed upright by a piston and spring, the bottom end of which is rotatably connected to the said fixed upright and the top end of which is connected to the said moving upright. The spring piston is preferably permanently compressed.

Preferably the device comprises a joint at each transverse end of the sheet-gripping means, the said sheet-gripping means comprising a transverse beam and a number of lugs extending towards the front of the device and co-operating with the beam to form a first comb disposed above the front edge of the bearing surface, the said front edge of the bearing surface being profiled in the form of a second comb complementary with the first comb in order to nip the said edge zone of a sheet between them.

The beam constituting the sheet-gripping means and mounted on lateral uprights via a lever system forming articulated parallelograms on each side will normally have a slight lateral clearance between the components in relative motion, which may result in interference with the lateral motion of the bearing-surface actuators. To eliminate this lateral clearance, the device according to the invention can comprise at least one spring strip, flexible in a vertical plane and rigid in the transverse direction and connecting the sheet-gripping means to a lateral upright integral with the bearing surface.

More particularly the device can comprise a pair of spring strips made of polyester reinforced with glass fibre or more simply of spring steel, each fixed to a substantially horizontal plate integral with a said upright and also fixed to a plate integral with the end of the beam of the sheet-gripping means.

BRIEF DESCRIPTION OF THE DRAWINGS

Other features and advantages of the device according to the invention will be clear to the skilled man from the following description of an embodiment of the invention in connection with the drawings, in which.

DETAILED DESCRIPTION

Figure 1:
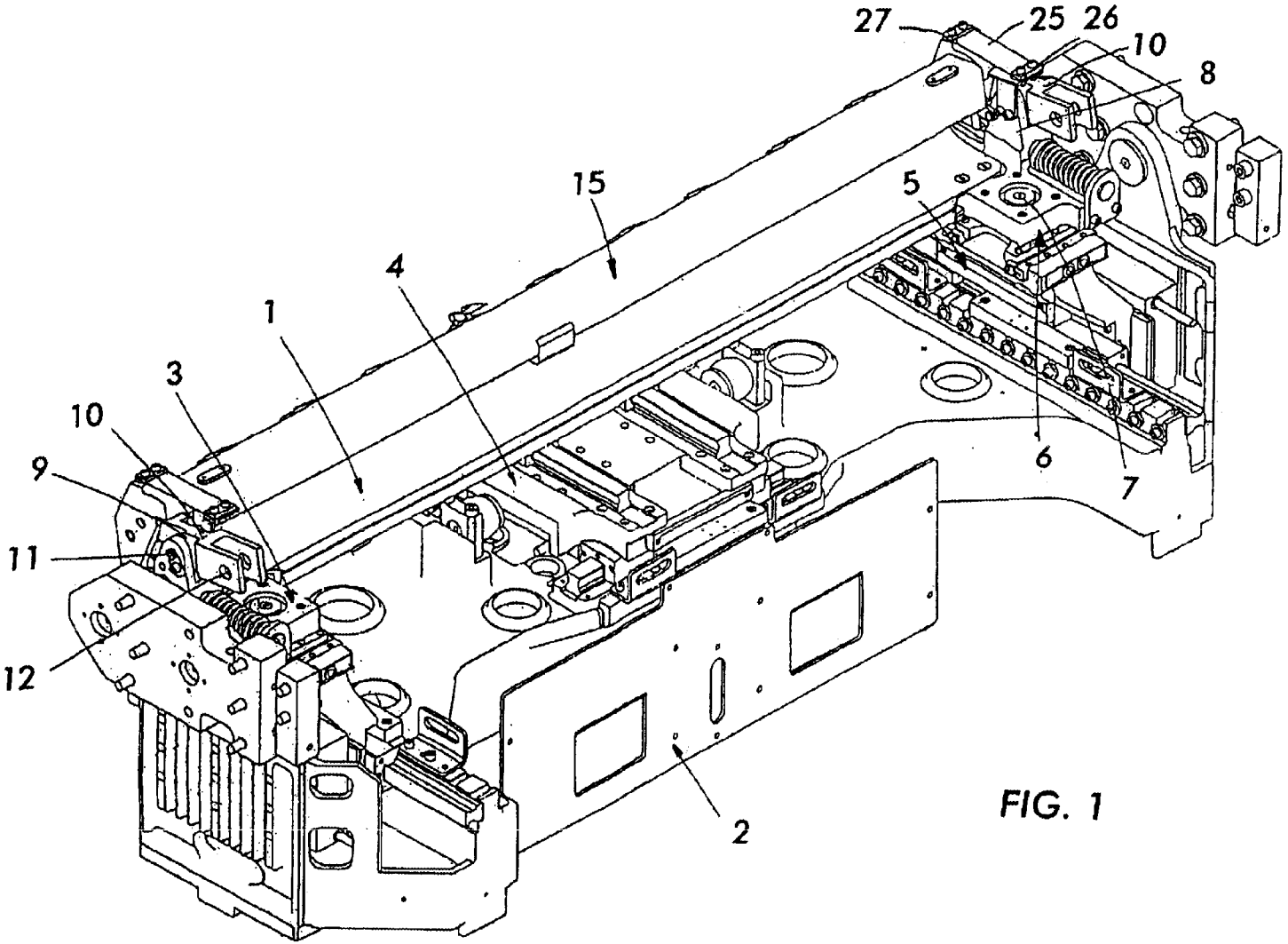
FIG. 1 is a perspective view of a device according to the invention.

FIG. 1 is a 3/4 rear perspective general view of the positioning device for gripping in a shaping press. A movable bearing surface 1 is mounted on a frame 2 via three actuating assemblies 3, 4 and 5. The bearing surface 1 is connected to three vertical pivots, i.e. a central pivot and two lateral pivots, secured to three respective slides moving on longitudinal and transverse slideways. The slideways are borne by movable bars comprising permanent magnets constituting the rotors of linear electric motors, the stators of which rest on respective pedestals at the centre and at the side edges of the frame 2. Permanent-magnet actuators of this kind, with good dynamic efficiency, are commercially available, e.g. sold by Messrs Etel (Switzerland), reference LMA11/50.

The positioning device also comprises position detectors (not shown in the drawings) i.e. a pair of cells for detecting the front edge of a sheet and disposed transversely side by side and at least one row of lateral cells for detecting the lateral edge of the same sheet. The cell readings are processed by a microprocessor which also knows the path taken by the bearing surface 1, determines any error in positioning the sheet relative to its theoretical position, and calculates the desired corrections to be made by the electric motors of the three actuating assemblies. The basic reciprocating motion can be corrected by a varying amount of longitudinal translation if the sheet is slightly forward or behind, or by transverse translation if the sheet is slightly off-centre, or by rotation induced by differential translation of the actuators 3 and 5 if the sheet is slightly askew.

Figure 3:
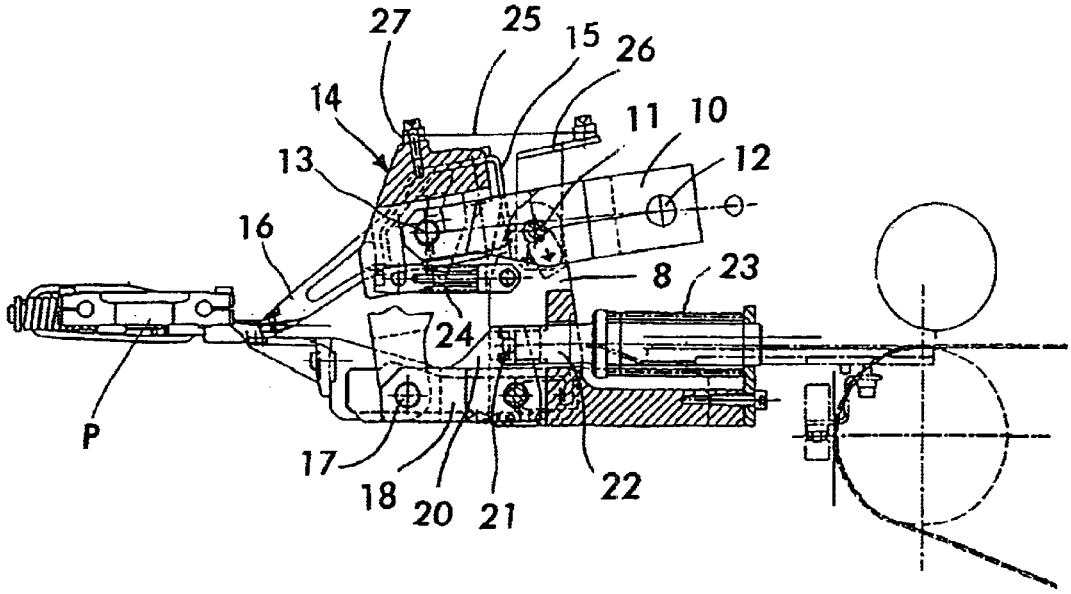
FIG. 3 is a view in section in the dotted-line plane in FIG. 1 of the said joint in the closed position, together with a gripper of the gripping bar and the end of the feed board.

The device in the adjusted position stops opposite a gripper bar open in the waiting position as shown in FIG. 3 where a gripper P is shown, the front edge of the sheet being inserted into the grippers on the gripper bar. The grippers on the gripper bar close and the sheet-gripping means in the positioning device opens. The bearing surface returns to its rear or starting position and the linear motors return to their respective neutral positions. A new sheet-supply cycle can then begin.

As FIG. 1 shows, the bearing surface 1 is fixed at each lateral end to a horizontal plate 6 which receives a vertical shaft 7 of an actuator group and also is prolonged vertically upwards by a fixed upright 8 secured to the bearing surface. For convenient of language, the terms "fixed" and "moving" in the case of components of the joint are used here with reference to the bearing surface 1, although the said surface itself moves relative to the frame 2. The upright 8 has a slot 9 in the longitudinal direction of the device, receiving an upper actuating lever 10 which pivots around the fixed upright 8 around an upper fixed pivot 11. The pivot axis can be embodied in the form of a smooth sleeve extending through the two arms of the fixed upright and of the upper actuating lever.

Figure 2:
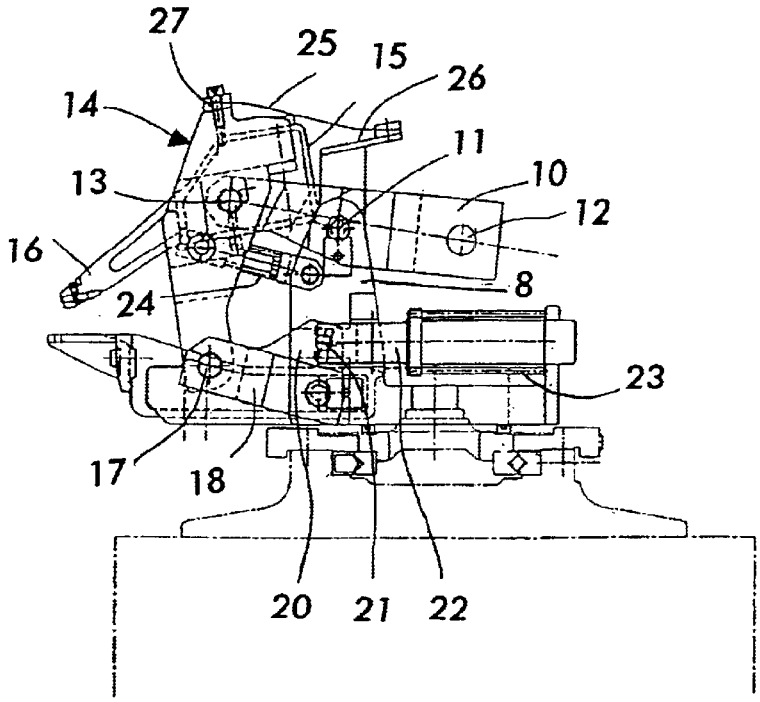
FIG. 2 is a view in side elevation of the joint between the sheet-gripping means and the bearing surface in FIG. 1, in the open position.

As shown in FIGS. 1 and 2, the lever 10 at its top end has a pair of holes having an axis 12 for pivoting a lever controlling the gripping means. The joint can be made via a rod (not shown in the drawings).

At its second end, the upper actuating lever 10 is pivoted around an axis of rotation 13 to a movable upright 14. The axis of rotation 13 can itself be embodied in the form of a smooth sleeve. The movable upright 14 is secured to the lateral ends of a transverse beam 15. The transverse beam 15 has lugs 16 extending to the front and regularly spaced and forming a comb with the transverse beam 15 and co-operating therewith to form the sheet-gripping means.

The upright 14 is prolonged downwards as shown in FIG. 2. Its bottom end is rotatably connected around a horizontal axis 17 to the second end of a bottom return lever 18, the top end of which is connected for rotation around an axis 19 to the fixed axis 8. The axes 17 and 19 can be embodied in the form of smooth sleeves.

The fixed upright 8, the upper actuating lever 10, the moving upright 14 and the lower return lever 18 constitute an articulated parallelogram. Consequently the sheet-gripping means integral with the upright 14 moves in translation. As a first approximation, this movement in translation may be considered as vertical translation, since the axes 11 and 19 are situated almost vertically one above the other and the actuating lever 10 moves on either side of a perpendicular to a perpendicular to and connecting the two axes, over a relatively small angle.

The return lever 18 has an upper protuberance 20 bearing a lateral pin 21. A piston 22 comprising a permanently compressed spring 23 mounted on plate 6 permanently acts on the pin 21 so as to push back the lever 18 horizontally and thus hold the sheet-gripping means pressed against the bearing surface 1 when in the closed position.

At the moment when the sheet-gripping means opens, a control lever (not shown) connected at the level of the axis 12 acts on the piston 22 via the articulated parallelogram and overcomes the force of the spring 23 and opens the sheet-gripping means.

The axis or shaft assembly 11, 13, 17 and 19 of its nature has a slight radial clearance. Consequently when the control lever on the shaft 12 is brought into action in order to open the sheet-gripping means, there may be a slight impact at the very moment when the actuators are finally correcting the position for gripping. To avoid such an impact, the device comprises a second spring piston 24 rotatably connected at one end to the fixed upright 6 and at the other end to the movable upright 14 in order to follow the deformation of the parallelogram. The spring piston 24 is disposed substantially parallel to the levers 10 and 18, and the spring of the spring piston 24 is permanently compressed. It thus exerts a permanent force, substantially parallel to the axes 11, 13, 17 and 19, and maintains the maximum spacing between the axes 11 and 13 on the one hand and 17 and 19 on the other hand, so as to eliminate the radial clearance.

As shown in FIG. 1, the device comprises two identical joints disposed symmetrically at the two ends of the beam 15 of the sheet-gripping means. Two systems of control levers (not shown) simultaneously act in the same way on the two joints, so that opening of the sheet-gripping means does not result in any torque capable of influencing the positions corrected by the actuator assemblies.

The assembly comprising the two joints disposed on the two sides of the sheet-gripping means comprises eight smooth sleeves for twice four shafts, for vertical motion in translation of the sheet-gripping means. This arrangement of its nature results in some transverse clearance at the beam 15 between the two joints. To suppress this lateral clearance, the device comprises a spring strip 25 on each side of the beam 15, fixed at one end to a substantially horizontal fixing plate 26 integral with the fixed upright 8 or integrally fixed thereto. Each spring strip 25 is fixed at the other end to a horizontal plate 27 secured to the moving beam. In the embodiment shown in FIG. 1, the second horizontal plate 27 constitutes a protuberance at right angles to the movable upright 14, itself integral with the beam 15. In the present example, the spring strip 25 is of polyester reinforced with glass fibre. Of course the spring strip 25 could be made from another material having similar elastic properties. The strip is flexible in a vertical plane and accompanies the opening or closing movement of the sheet-gripping means. On the other hand it is rigid in the transverse direction and prevents any transverse sliding of the sheet-gripping means on the sleeves constituting the axes of rotation of the articulated parallelograms.

What is claimed is:

1. A device for positioning sheets in a station of a sheet-processing machine, comprising a movable bearing surface located in a plane, the bearing surface being for holding at least an edge zone of a sheet, an actuator moving the bearing surface in the plane thereof, a gripper device accompanying the bearing surface in the movement and the gripper device being adapted to grip or release the edge zone of the sheet between the gripper device and the bearing surface, at least one joint connecting the sheet gripper device to the bearing surface, the joint comprising a number of levers, the levers forming an articulated parallelogram around horizontal axes at respective pivots.

2. A device according to claim 1, wherein the joint comprises a fixed upright secured to the bearing surface and the upright receiving an upper fixed one of the pivots and a lower fixed one of the pivots disposed substantially one above the other.

3. A device according to claim 2, wherein the joint comprises an upper actuating lever having a central part connected for rotation around the upper fixed pivot, the upper actuating lever having a first end, a shaft rotatably connecting the first end of the upper actuating lever to a lever for controlling the gripper device; a second movable upright, the upper actuating lever having a second end connected to the second movable upright, and the joint also comprises a lower return lever having a first end connected for rotation around the lower fixed pivot, the lower return lever having a top end rotatably connected to a bottom end of the movable upright, the movable upright being integral with the sheet gripper device.

4. A device according to claim 3, wherein the joint comprises a piston and a spring permanently acting on the lower return lever to press the sheet gripper device against the bearing surface.

5. A device according to claim 4, wherein the movable upright is integral with the sheet gripper device, a second piston and a spring rotatably connecting the movable upright to the fixed upright, wherein the second piston has a first end which along with the spring is connected to the fixed upright and the second piston has a second end which is connected along with the spring to the movable upright.

6. A device according to claim 5, wherein the spring of the piston is permanently compressed.

7. A device according to claim 1, wherein there is at least one of the joints at each end of the sheet gripper device in the transverse direction, the sheet gripper device comprising a transverse beam and a number of lugs extending towards a front of the device and forming a first comb with the beam, the comb being disposed above a front edge of the bearing surface, the front edge of the bearing surface having a profile of a second comb complementary with the first comb in order to grip the edge zone of the sheet between them.

8. A device according to claim 7, further comprising at least one spring strip flexible in a vertical plane but rigid in a transverse plane, connecting the sheet gripper device to a lateral fixed upright.

9. A device according to claim 8, further comprising a pair of spring strips of polyester reinforced with glass fiber, each spring strip fixed to a substantially horizontal plate integral with one of the uprights and also fixed to a plate integral with the end of the beam of the sheet gripper device.

10. A press for shaping sheets of paper or cardboard wherein the press comprises a positioning device according to claim 1, disposed between a feed board and a cutting station.

* * * * *